United States Patent [19]

Frayer et al.

[11] 4,173,528

[45] Nov. 6, 1979

[54] MULTISTAGE RESIDUAL OIL HYDRODESULFURIZATION PROCESS EMPLOYING SEGMENTED FEED ADDITION AND PRODUCT REMOVAL

[75] Inventors: James A. Frayer, Pittsburgh; Harry C. Stauffer, Cheswick; Stephen J. Yanik, Valencia, all of Pa.

[73] Assignee: Gulf Research and Development Company, Pittsburgh, Pa.

[21] Appl. No.: 843,879

[22] Filed: Oct. 20, 1977

[51] Int. Cl.[2] ..... C10G 23/02

[52] U.S. Cl. ..... 208/210

[58] Field of Search ..... 208/210, 89

[56] References Cited

U.S. PATENT DOCUMENTS

| | | | |
|---|---|---|---|
| 3,519,557 | 7/1970 | Pruiss | 208/210 |
| 3,617,526 | 11/1971 | Coons, Jr. et al. | 208/210 |
| 3,663,434 | 5/1972 | Bridge | 208/210 |
| 3,876,530 | 4/1975 | Frayer et al. | 208/210 |
| 3,968,028 | 7/1976 | Frayer et al. | 208/210 |

*Primary Examiner*—George Crasanakis

[57] ABSTRACT

In the catalytic hydrodesulfurization of residual oil the amount of hydrogen consumed per atom of sulfur removed is relatively low until the desulfurization becomes deep, whereupon the amount of hydrogen consumed per atom of sulfur removed becomes relatively high. The present invention provides a multistage process capable of producing products of low sulfur content while avoiding deep desulfurization of the heavy portion of the residual oil so that hydrogen consumption is diminished. The feed oil is fractionated to provide a residual fraction, a heavy distillate fraction and a light distillate fraction. The residual fraction and hydrogen are charged to an upstream hydrodesulfurization stage. A portion of the upstream stage residual oil effluent stream is split out of the process for use as refinery fuel and the remaining portion of the upstream stage effluent stream is charged to an intermediate hydrodesulfurization stage together with the heavy distillate feed fraction and hydrogen. A portion of the intermediate stage effluent stream is split out of the process as product fuel oil and the remaining portion of the intermediate stage effluent stream is passed to a downstream hydrodesulfurization stage together with the light distillate feed fraction and hydrogen. The downstream stage effluent stream constitutes the final and highest grade product of the process. Because of the combination of segmented feed addition and segmented product removal, not only are residue-containing streams removed from the process at the earliest possible time to avoid overtreating relative to their intended use, but also the removed streams are diluted with a reduced amount of low boiling distillate oil, conserving as much of the low boiling distillate oil as possible for inclusion in the product of the final stage. This method conserves distillate feed oil for the final and highest grade product and allows each hydrodesulfurization stage to be provided with a non-aliquot distillate-residual oil stream which is richer in low boiling distillate oil than its predecessor hydrodesulfurization stage.

8 Claims, 2 Drawing Figures

Figure 1:
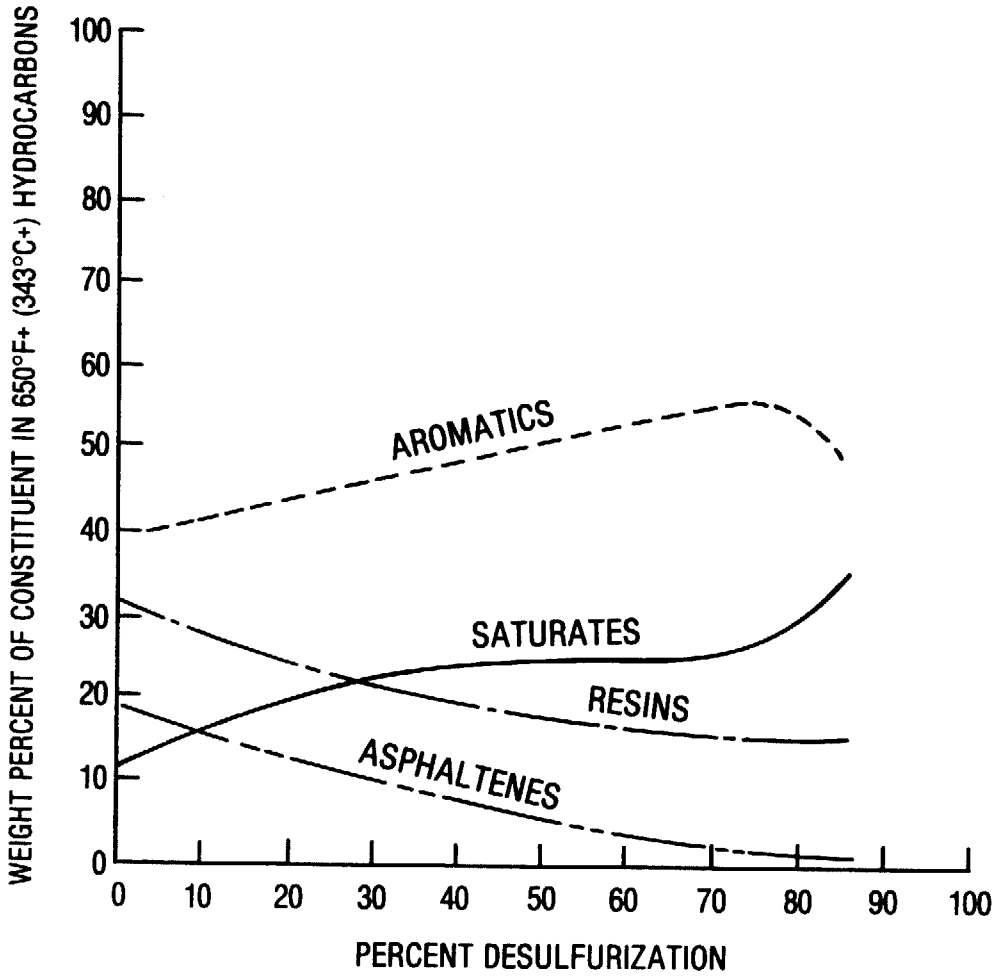

MULTISTAGE RESIDUAL OIL HYDRODESULFURIZATION PROCESS EMPLOYING SEGMENTED FEED ADDITION AND PRODUCT REMOVAL

This invention relates to a multistage process for the catalytic hydrodesulfurization of residual oils containing metals, sulfur and asphaltenes.

When residual oils, such as petroleum residuals, are desulfurized in the presence of molecular hydrogen, the hydrogen consumption economy of the desulfurization reaction decreases as the depth of sulfur removal increases. For example, in the catalytic hydrodesulfurization of a 650° F.+ (343° C.+) Kuwait reduced crude oil containing 4 weight percent sulfur, it was found that removal of 3 of the 4 weight percent sulfur present in the oil to reduce the sulfur content of the oil to 1 weight percent requires a hydrogen consumption of about 500 standard cubic feet per barrel (9 SCM/100 L), providing a hydrogen efficiency of 167 standard cubic feet of hydrogen (4.68 $M^3$) per percent of sulfur in the oil which is removed. The removal of the next 0.7 weight percent increment to reduce the sulfur content of the oil to 0.3 weight percent requires a hydrogen consumption of 165 standard cubic feet per barrel (2.97 SCM/100 L), providing a hydrogen efficiency of 236 standard cubic feet of hydrogen (6.61 $M^3$) per percent of sulfur in the oil which is removed. Finally, the removal of an additional 0.2 weight percent sulfur increment to reduce the sulfur content of the oil to 0.1 weight percent requires a hydrogen consumption of 170 standard cubic feet per barrel (3.07 SCM/100 L), providing a hydrogen efficiency of 850 standard cubic feet of hydrogen (23.8 $M^3$) per percent of sulfur in the oil which is removed. These data show that with removal of progressively deeper increments of sulfur from the residual oil the hydrodesulfurization process becomes progressively hydrogen inefficient as evidenced by the fact that removal of the final 0.2 weight percent increment of sulfur in the oil requires about 5 times the hydrogen consumption per atom of sulfur removed as compared to the hydrogen consumption during the removal of the first 3 weight percent increment of sulfur in the oil.

We have now discovered a method for the multistage desulfurization of residual oil which provides a desulfurized product having a relatively low sulfur level while avoiding deep, hydrogen-inefficient hydrodesulfurization of the heavy portion of the residual oil. The present invention involves a hydrodesulfurization operation employing upstream, intermediate and downstream catalytic stages in series, wherein both the feed oil and the hydrodesulfurized product is segmented, with individual fractions of the total feed oil being charged to separate stages and with each stage producing its individual segment of the total product. The product is segmented by the removal of a portion of each concentrated residual oil stream flowing between stages, allowing the non-removed residual portion to flow to the next stage. Segmented feed addition cooperates with segmented product removal in the process of this invention to concentrate residual components in the relatively low grade interstage products, while enriching the distillate concentration in the high grade product of the final stage. Thereby, the products flowing from the intermediate and downstream stages contain non-aliquot ratios of distillate to residual components and the process stream is progressively impoverished or depleted with respect to residual components while it is progressively enriched in distillate components. Since the sulfur in the distillate oil is relatively nonrefractory, the progressive dilution of residual components with distillate oil relieves the intermediate and downstream stages of the necessity of accomplishing extremely deep desulfurization of refractory residual components in order to produce low sulfur effluent streams.

In accordance with the present invention, crude or reduced crude feed oil containing substantially all the asphaltenes of the full crude is distilled to prepare individual residual and relatively heavy and light distillate fractions or hydrodesulfurization. The residual fraction can comprise 850° F.+ (454° C.+) oil. The heavy distillate fraction can comprise 650° to 850° F. (343° to 454° C.) oil. The light distillate fraction can comprise 450° to 650° F. (232° to 343° C.) oil. Fractions having these or other boiling ranges can be employed. The residual fraction is passed to the first or upstream hydrodesulfurization stage; the heavy distillate fraction by-passes the upstream stage and is passed directly to the intermediate stage; and the light distillate fraction by-passes both the upstream and intermediate stages and is passed directly to the final or downstream stage. A portion of the upstream stage effluent stream is split out of the process and the remaining portion is passed to the intermediate stage together with the heavy distillate fraction. A portion of the intermediate stage effluent stream is split out of the process and the remaining portion is passed to the downstream stage together with the light distillate feed fraction. The greater the amount of distillate oil separated from the residual fraction at the feed distillation column, the greater will be the dilution of the non-removed residual components when blended with the respective distillate fractions in the intermediate and downstream stages. An amount ranging between about 10, 20 or 30 up to 50, 65 or 75 weight percent of the essentially full range normally liquid material in the upstream and intermediate stage effluent streams is removed from the process. The same or a different percentage can be removed from the respective effluent streams.

The present invention has particular utility where at least one of the concentrated residue streams removed between the hydrodesulfurization stages is utilized as refinery fuel. The permissible sulfur levels for fuels employed in a refinery are generally higher than for fuels prepared for general commercial consumption. In the event that the sulfur level of any interstage residual stream exceeds the maximum permissible level for refinery use, the residual fraction can be blended with one or more relatively low sulfur, low value streams available in a refinery, such as cycle oil or decanted oil. The availability of these low sulfur, low value streams in a refinery contributes to the utility as refinery fuel of a residue stream taken between the hydrodesulfurization stages.

The decrease in the hydrodesulfurization duty of the process resulting from an increase in the aliquot ratio of distillate to residue components in the stream being treated is illustrated by the data of Table 1. Table 1 shows the volume percent of various boiling range fractions and the sulfur content of each fraction in a hydrodesulfurization effluent stream containing 0.15 weight percent sulfur obtained by hydrodesulfurization of a 650° F.+ (343° C.+) Kuwait residual oil containing 4 weight percent sulfur.

TABLE 1

| TBP FRACTION | VOL. % OF TOTAL YIELD | WT. % SULFUR IN FRACTION | % OF TOTAL SULFUR IN PRODUCT |
|---|---|---|---|
| IBP-375° F. (IBP-191° C.) | 1.62 | 0.04 | 0.38 |
| 375-650° F. (191-343° C.) | 13.71 | 0.04 | 3.50 |
| 650-1065° F. (343-574° C.) | 68.11 | 0.09 | 40.84 |
| 1,065° F. + (574° C.+) | 16.56 | 0.47 | 55.28 |

Table 1 shows that more than half of the total sulfur in the product is contained in the highest boiling 16.56 volume percent fraction of the total yield, which is the 1065° F.+ (343° C.+) fraction. Therefore, if half of the 1056° F.+ (343° C.+) product fraction could be utilized as refinery fuel, removal of this segment would constitute removal of only about 8 volume percent of the stream but would accomplish removal of about 28 weight percent of the total sulfur in the stream. It is seen that removal of a relatively small volumetric portion of the total stream when, the removed portion is a concentrated residue fraction, substantially diminishes the sulfur concentration in a remaining non-aliquot distillate-residue stream. The method of this invention thereby greatly reduces the depth of hydrodesulfurization required to produce an ultimate product having a low sulfur level. In this manner, a product having a low sulfur level can be produced with a relatively high hydrogen efficiency.

The data of Table 1 indicate that the most refractory sulfur in a residual oil is concentrated in the highest boiling fraction, which is the asphaltene-containing fraction. Asphaltenes are non-distillable. However, some of the non-distillable asphaltenes in the feed oil are upgraded to distillate material via hydrodesulfurization in a first hydrodesulfurization stage, leaving the most refractory asphaltenes in the first stage effluent. This is illustrated by FIG. 1, herein, which was also presented in U.S. Pat. No. 3,761,399, and which shows the proportions of aromatics, saturates, resins and asphaltenes in a 650° F.+ (343° C.+) residual oil as the oil experiences progressive catalytic hydrodesulfurization. The resins and asphaltenes comprise the residue of a propane extraction of the oil. Resins and asphaltenes are subsequently separable by a pentane extraction since resins are soluble in pentane while asphaltenes are not. As shown in FIG. 1, the resin and asphaltene content of the oil steadily decreases with increasing hydrodesulfurization. This decrease is due to the severing of carbon-sulfur bonds, thereby breaking off molecular fragments. The accumulation of these molecular fragments is reflected in FIG. 1 by the indicated buildup of lower molecular weight saturates and aromatics. When the desulfurization level reaches about 75 percent, the resin and asphaltene content of the oil becomes stable, indicating little additional severing of molecular fragments therein. At the same time, the total aromatics and saturates content also tends to stabilize, with any increase in saturates level being accompanied by a decrease in aromatics level. This indicates that after about 75 percent desulfurization the process tends to consume hydrogen by hydrogenation of aromatics, which represents a fruitless consumption of hydrogen.

It has been observed in conventional residual oil hydrodesulfurization processes which produce a very low sulfur residual oil product, requiring more than about 90 or 95 weight percent desulfurization, the unconverted asphaltenic material in the product becomes highly incompatible with the lower boiling oils and tends to settle out of solution. This incompatibility may arise because the hydrogen consumed during deep desulfurization is selectively acquired by the lower boiling oils, as indicated by the increase in saturates level in FIG. 1, while refractory asphaltenes are impervious to hydrogenation, thereby inducing a widened differential in the hydrogen to carbon ratios of the unconverted asphaltenes and the hydrogenated oils. The removal of a portion of a concentrated stream of asphaltenes from the process reduces the level of hydrogenation required to produce a low sulfur product so that the stability of the refractory asphaltenes remaining in the hydrodesulfurized oil tends to be improved.

FIG. 1 shows that a substantial portion of the feed asphaltenes (the general term "asphaltenes" as used herein includes both asphaltenes and resins, since both are non-distillable materials) can be converted to saturates and aromatics in an upstream hydrodesulfurization stage. The demonstration in FIG. 1 that a substantial portion of the feed asphaltenes can be converted is the reason that a portion of the asphaltenes is not removed directly from the feed oil in the process of the present invention. By removing asphaltenes from upstream and intermediate stage effluent streams rather than directly from the feed oil, the asphaltene removal is selective towards refractory asphaltenes. The demonstration in FIG. 1 that an attempt to convert the refractory asphaltenes becomes progressively more difficult and results in a wasteful consumption of hydrogen, as evidenced by a conversion of aromatics to saturates, is the reason that individual portions of the refractory asphaltenes are removed in advance of the intermediate and downstream stages, respectively. In this manner, asphaltenes are not overtreated relative to their intended use.

Data were also presented in U.S. Pat. No. 3,761,399 showing that in a non-desulfurized residual oil the sulfur concentrations in the various fractions are relatively uniform and that it is in the course of the hydrodesulfurization operation that the highest sulfur concentration devolves to the high boiling refractory asphaltene fraction. Table 2 shows the progressive changes in sulfur concentration occurring in various fractions during two stage catalytic hydrodesulfurization of a reduced crude oil containing 4.09 weight percent sulfur. The 650° F.+ (343° C.+) product of the first stage had a sulfur content of 1.09 weight percent while the corresponding second stage effluent oil contains 0.58 weight percent sulfur.

TABLE 2

| | Feed to first stage (4.09 wt. % sulfur) | | Feed to second stage (1.09 wt. % sulfur) | | Product from second stage (0.58 wt. % sulfur) | |
|---|---|---|---|---|---|---|
| | Fraction | Sulfur in Fraction | Fraction | Sulfur in Fraction | Fraction | Sulfur in Fraction |
| Percent by wt.: | | | | | | |
| Saturates | 17.98 | 3.42 | 22.24 | 0.80 | 22.34 | 0.49 |
| Aromatics | 55.45 | 5.04 | 60.45 | 1.12 | 61.91 | 0.56 |
| Resins | 16.73 | 5.59 | 13.76 | 2.37 | 12.72 | 1.56 |
| Asphaltenes | 9.84 | 6.99 | 3.55 | 4.95 | 3.03 | 3.13 |

Table 2 shows that the sulfur levels in the various fractions of the feed oil are relatively uniform. However, during passage of the feed oil through the first hydrodesulfurization stage the saturates and aromatics lose sulfur to the greatest extent, while the resins and asphaltenes lose sulfur to the least extent. The same occurs during second stage hydrodesulfurization.

Table 3 contains data from U.S. Pat. No. 3,761,399 which show the effect of catalytic hydrodesulfurization upon the boiling range of a residual oil. In the tests of Table 3, the reduced crude was hydrodesulfurized in three stages.

TABLE 3

| | Feedstock | Effluent from each of three desulfurization stages | | |
|---|---|---|---|---|
| Sulfur, percent by wt. | 5.43 | 4.77 | 1.41 | 0.83 |
| Boiling range, °F. | 599–1,400+ (297–560° C.+) | 514–1,400+ (268–560° C.+) | 509–1,400+ (265–560° C.+) | 466–1,400+ (241–560° C.+) |
| Desulfurization, percent | — | 12.2 | 74.0 | 85.0 |

The data of Table 3 show that while the first 74 percent of the sulfur in the oil was being removed, the IBP of the oil was reduced from 566° to 509° F. (297° to 265° C.), or 57° F. (32° C.), while the attempt to reduce the sulfur content only slightly further to achieve 85 percent desulfurization induced reduction of the IBP to 466° F. (241° C.), or an additional 43° F. (24° C.). These data show that the first 74 percent desulfurization has a relatively small effect upon boiling point reduction, while the removal of the more refractory sulfur has a greater effect upon boiling point reduction. It is a significant feature of the present invention that since desulfurization is achieved in part by a dilution effect in place of deep hydrodesulfurization, the process of the present invention can diminish even the small amount of boiling point reduction shown in the above table, thereby reducing hydrogen consumption.

The catalyst of the first stage of a multi-stage residual oil hydrodesulfurization system is not greatly deactivated by coking because relatively reactive asphaltenes are available for conversion in the first stage. In multistage residual oil hydrodesulfurization processes, most of the sulfur is removed in the first stage. For example, the first stage generally removes 60, 70, 75 or more weight percent of the sulfur content in the feed oil. However, the more refractory asphaltenes pass unconverted through the first stage and it is the sulfur in these refractory asphaltenes that conventionally must be removed in second and third hydrodesulfurization stages. Unfortunately, refractory asphaltenes are known coke formers and the removal of sulfur therefrom in a downstream stage is conducive to coke formation. Therefore, in conventional multistage hydrodesulfurization operations, while coke formation is not significant in the first stage, the second and third stage catalyst is generally deactivated by coke, and the deactivation of the second and third stage catalyst generally occurs more rapidly than the deactivation of the first stage catalyst. The coke problem in a second or third stage is the reason for the use of a specialized coke-resistant catalyst in downstream stages, such as the Group IV-B metal-promoted coke resistant second stage catalyst utilized in the process of U.S. Pat. No. 3,968,027.

The amount of coking in a second or subsequent hydrodesulfurization stage generally increases with the concentration of refractory asphaltenes in the oil stream flowing through those stages. Downstream hydrodesulfurization catalysts tend to induce coking via agglomeration and polymerization of refractory asphaltene molecules. These reactions occur because desulfurization catalysts are hydrogenation-dehydrogenation agents and since the asphaltenes in the downstream stage are refractory to hydrodesulfurization their residence time at the surface of the catalyst is extended, blocking access of hydrogen to the catalyst, and it is this inaccessibility of hydrogen which induces dehydrogenation and ultimately coking. Any increase in the concentration of refractory asphaltenes tends to increase the incidence of agglomeration and polymerization so that, conversely, in accordance with the present invention, the amount of coking in the intermediate and downstream stages is reduced via interstage removal of a portion of the refractory asphaltenes and by dilution of the non-removed asphaltenes prior to their entry into a subsequent stage. The removal of a segment of the concentrated asphaltene streams flowing from the upstream and intermediate stages in accordance with this invention constitutes selective removal of the most refractory molecules in the system. Dilution of the non-removed asphaltenes with non-desulfurized distillate oil shifts the desulfurization duty of the catalyst in the intermediate and downstream stages from the refractory heteroatom sulfur embedded within polycondensed aromatic rings of asphaltenic molecules to the more reactive thiophenic sulfur in distillate molecules.

The streams flowing through the intermediate and final stages comprise non-aliquot ratios of distillate to residual components since they contain progressively decreasing amounts of the asphaltenic components. The progressively diminishing quantity of refractory asphaltenes entering the intermediate and downstream stages will have the benefit of the dilution and viscosity reducing effects of progressively increasing amounts of progressively lower boiling distillate portions of the feed oil. It was shown in U.S. Pat. No. 3,761,399 that the rate of hydrodesulfurization of a residual fraction can be improved by diluting the residual fraction with highly desulfurized gas oil, probably due to solubilizing of viscous, high molecular weight sulfur-containing molecules and improving their mass transfer in the system. That patent further showed that excessive dilution of a residual fraction with highly desulfurized gas oil can inhibit the rate of desulfurization of the residual fraction, probably due to excessive dispersal of the sulfur-containing molecules. However, the present invention tends to circumvent the problem of a diminished rate of intermediate and downstream stage residual oil desulfurization. This invention permits a relaxation of dependence upon deep desulfurization of the residual fraction by practicing the interdependent operations of selective removal from the process of concentrated streams of sulfur-refractory residual components and dilution of the non-removed residual components with distillate fractions of the feed oil, so that the oil streams flowing through the intermediate and downstream stages comprise non-aliquot mixtures of residual and distillate components, as compared to the feed oil. In this manner, in the intermediate and downstream stages the quantity of the most sulfur-refractory material in the feed oil is diminished concomitantly with an increase in the concentration of the most sulfur-reactive material in the feed, releasing the process from the burden of accomplishing a deep desulfurization of residual components in order to achieve a low sulfur product.

Since the refractory asphaltenes removed between the stages is the material which would have contributed most heavily to coking in the intermediate and downstream stages, the total liquid yield of the process is enhanced by avoiding conversion of liquid material to coke. This advantageous yield effect provides a concomitant advantageous catalyst aging effect since diminution of coke formation in the intermediate and downstream stages tends to extend the active life of the catalyst in those stages.

The present invention relates to a plural stage process for the hydrodesulfurization of an asphaltene-containing residual oil in which at least three different streams of hydrodesulfurized residual oil are removed from the process with each removed stream having a different sulfur content and boiling range as it is separated from the process, without any product blending or product distillation steps being required to accomplish these differences. The upstream product residual oil stream has a narrow boiling range and a relatively high sulfur level while the intermediate and downstream product residual oil streams have progressively wider boiling ranges and progressively lower sulfur levels. The lowest sulfur residual oil stream is the product of the downstream stage, which meets the most demanding sulfur specifications for commercial fuels to be burned in densely populated areas. The higher sulfur level residual oil products have a higher average boiling point and meet the less demanding specifications for refinery fuels. As noted above, refinery fuels can utilize high sulfur streams because of the availability in refineries of low quality but low sulfur streams for blending, such as cycle oil or decanted oil. Removal of the refinery fuel streams in the process of this invention avoids overtreating of any portion of the total stream, relative to its intended use, resulting in a significant savings in hydrogen, in extended catalyst life and in increased liquid yield in the process. The increased liquid yield results from reduced conversion to coke.

The hydrodesulfurization catalyst of all of the stages of the present process comprises at least one Group VI metal and at least one Group VIII metal on a non-cracking support. Suitable Group VI and Group VIII metal combinations include cobalt-molybdenum, nickel-tungsten and nickel-molybdenum. A preferred combination is nickel-cobalt-molybdenum. The catalyst support comprises a highly porous, non-cracking supporting material. Alumina is the preferred supporting material, but other porous, non-cracking supports can be employed, such as silica-alumina and silica-magnesia.

The catalyst in the intermediate and/or downstream stages can be the same as or different from the catalyst employed in the upstream stage. For example, the proportions of catalytic metals can be the same or can be different. The composition of the intermediate and/or downstream catalyst can be generally the same as the composition of the upstream stage catalyst except that it can contain a promoting amount of Group IV-B metal, such as titanium, zirconium or hafnium, preferably titanium, Promotion with a Group IV-B metal improves the resistance of the intermediate and downstream stage catalyst to coking. However, removal of a portion of the refractory asphaltene stream in advance of the intermediate and downstream stages in accordance with this invention diminishes the need for a coke-resistant downstream catalyst.

In the present process, the oil is passed downwardly through a fixed bed of catalyst in each stage. A portion of the feed oil is passed through the upstream reactor only, another portion is passed through the downstream reactor only, a portion is passed through the upstream and intermediate stages only, a portion is passed through the intermediate and final stages only, and still another portion is passed through all stages. Very little hydrocracking occurs in the process. In general, at least 40 or 50 weight percent of the total hydrodesulfurization product boils above the IBP of the hydrodesulfurization feed oil and, preferably, at least 70, 80 or 90 weight percent of the hydrodesulfurization product boils above the IBP of the hydrodesulfurization feed oil. The hydrodesulfurization temperature should be sufficiently low that not more than 30 percent, generally, and preferably not more than about 20, 15 or even 10 percent of the 650° F.+ (343° C.+) feed oil will be converted to material boiling below 650° F. (343° C.).

The hydrodesulfurization process of this invention employs in each stage a hydrogen partial pressure of 500 to 5,000 pounds per square inch (35 to 350 kg/cm$^2$), generally, 1,000 to 3,000 pounds per square inch (70 to 210 kg/cm$^2$), preferably, and 1,500 to 3,000 pounds per square inch (105 to 175 kg/cm$^2$), most preferably. The gas circulation rate in each stage can be between 1,000 and 20,000 standard cubic feet per barrel (17.9 and 356 SCM/100 L), generally, or preferably about 2,000 to 10,000 standard cubic feet per barrel (35.6 to 178 SCM/100 L). The gas circulated preferably contains 85 percent, or more, of hydrogen. The mol ratio of hydrogen to oil in each stage can be between about 4:1 and 80:1. Reactor temperatures can vary between about 600° and 900° F. (316° and 482° C.), generally, and between about 650° and 800° F. (343° and 427° C.), preferably. Reactor temperatures are increased in each stage during a catalyst cycle to compensate for activity loss due to aging. The liquid hourly space velocity in each reactor can be between about 0.1 and 10, generally, and between about 0.2 and 1 or 2, preferably.

The process can be used for desulfurizing asphaltene-containing oils other than petroleum oils, such as coal liquids and oils extracted from shale and tar sands. Asphaltenes have a relatively low hydrogen to carbon ratio and will generally comprise less than half of the feed oil, but will generally contain most of the metallic components present in the total feed, such as nickel and vanadium.

Figure 2:
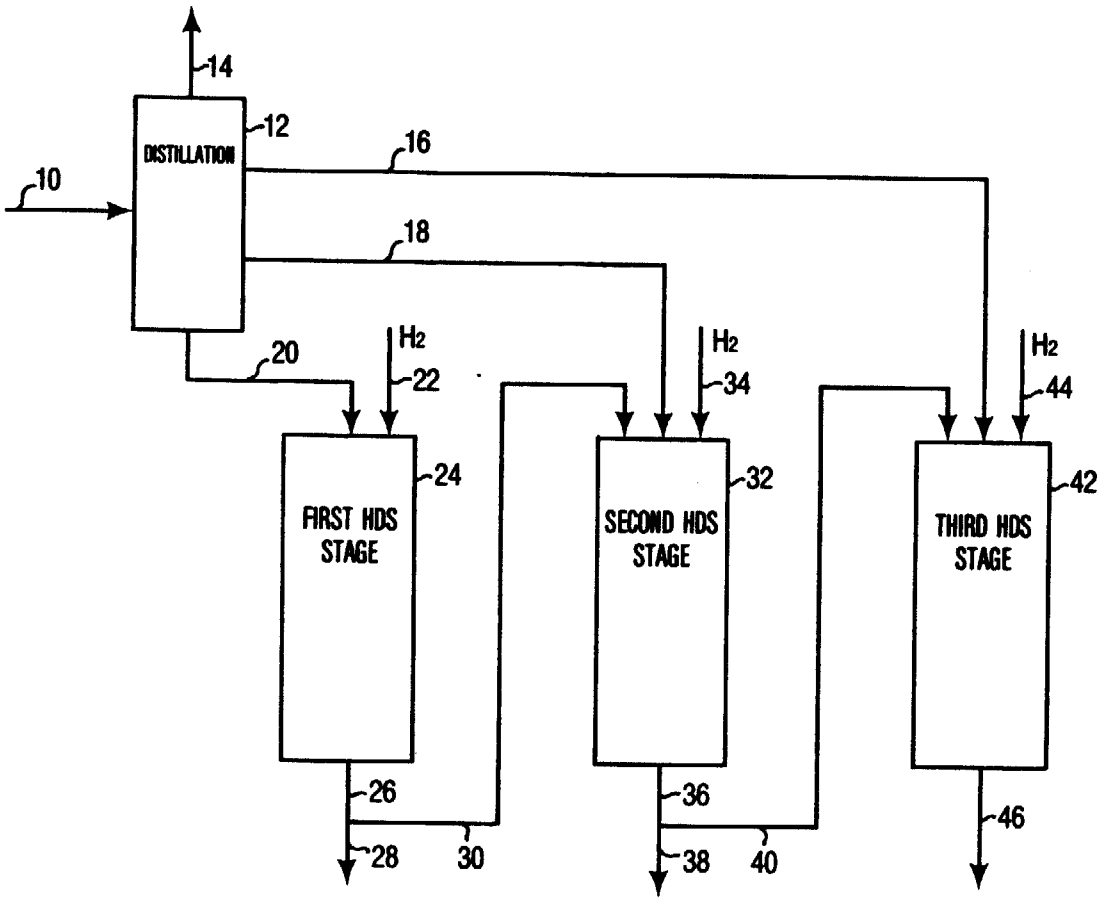

A process scheme for performing the present invention is presented in FIG. 2. As shown in FIG. 2, a crude oil or a reduced crude oil is passed through line 10 to distillation column 12. If the feed is a crude oil, a low boiling fraction is removed overhead from distillation column 12 through line 14, while a light distillate fraction, a heavy distillate fraction and a residual fraction typically containing about 4 weight percent sulfur are removed through lines 16, 18 and 20, respectively.

The residual oil fraction in line 20 and hydrogen gas passing through line 22 are passed to first catalytic hydrodesulfurization stage 24. A first stage effluent stream passes through line 26, a portion of which is removed from the process through line 28 while the remaining portion is passed through line 30 to second catalytic hydrodesulfurization stage 32. The stream removed from the process in line 28 can typically contain about 1 weight percent sulfur and can be used for refinery fuel. If desired, it can be blended with a relatively low sulfur refinery stream, such as FCC decanted oil or cycle oil.

The first stage effluent in line 30 is passed to second catalytic hydrodesulfurization stage 32 together with hydrogen passing through line 34 and heavy distillate oil passing through line 18. The heavy distillate oil in line 18 by-passes first hydrodesulfurization stage 24 and is passed directly to second hydrodesulfurization stage 32. A second stage effluent stream is removed through line 36 and a portion is removed from the process through line 38. The stream in line 38 can typically contain about 0.3 to 0.5 weight percent sulfur and constitutes commercial fuel oil.

The remaining second stage effluent in line 40 is passed to third catalytic hydrodesulfurization stage 42 together with hydrogen flowing through line 44 and light distillate oil flowing through line 16. The light distillate oil in line 16 by-passes first and second hydrodesulfurization stages 24 and 32 and is passed directly to third hydrodesulfurization stage 42. Third stage effluent is removed from the process through line 46 and typically contains about 0.1 weight percent sulfur. The stream in line 46 can be used as very high grade commercial fuel oil.

The process presented in FIG. 2 employs both segmented withdrawal of residual oil product and segmented addition of distillate feed oil. The segmented withdrawal of residual oil product insures that no portion of the residual oil product is overtreated, and thereby conserves catalyst and hydrogen. The segmented addition of distillate oil results in a minimized light oil content in each residual oil product stream which is withdrawn prior to production of the primary product which is obtained from the final stage.

We claim:

1. A process for the hydrodesulfurization of an aromatics- and asphaltene-containing feed oil to produce at least three hydrodesulfurized residual oil streams having different respective asphaltene and sulfur contents, said process employing upstream, intermediate and downstream hydrodesulfurization stages containing hydrodesulfurization catalyst comprising Group VI and Group VIII metal on a noncracking support at a temperature between 600° and 900° F. and a hydrogen pressure between 500 and 5,000 psi, said process comprising fractionating said feed oil into an asphaltene-containing residual oil stream, a heavy distillate oil stream and a light distillate oil stream, passing said residual oil stream and hydrogen through said upstream hydrodesulfurization stage and recovering an upstream stage effluent stream containing refractory sulfur asphaltenes, splitting said upstream stage effluent stream into a first upstream stage effluent portion comprising between about 10 and 75 weight percent of the normally liquid material in said upstream stage effluent stream and a second upstream stage effluent portion, removing said first upstream stage effluent portion from said process to selectively remove refractory sulfur asphaltenes from said process and to increase the concentration of more sulfur-reactive material in said intermediate stage, passing said second upstream stage effluent portion and said heavy distillate oil stream and hydrogen through said intermediate stage, said heavy distillate oil stream by-passing said upstream stage, recovering an intermediate stage effluent stream containing refractory sulfur asphaltenes, dividing said intermediate stage effluent stream into a first intermediate stage effluent portion comprising between about 10 and 75 weight percent of the normally liquid material in said intermediate stage effluent stream and a second intermediate stage effluent portion, removing said first intermediate stage effluent portion from said process to selectively remove refractory sulfur asphaltenes from said process and to increase the concentration of more sulfur-reactive material in said downstream stage, passing said second intermediate stage effluent portion and said light distillate oil stream and hydrogen through said downstream stage, said light distillate oil stream by-passing said upstream and intermediate stages, and recovering a downstream stage effluent stream, said downstream stage effluent stream containing aromatics and having a sulfur concentration which is at least 75 percent lower than the sulfur concentration of said feed oil, the removal of said first upstream stage effluent portion and said first intermediate stage effluent portion allowing the sulfur concentration in said downstream stage effluent stream to be achieved with a relatively high aromatics concentration as compared to the aromatics concentration when achieving the same sulfur concentration by hydrodesulfurization without selective removal of refractory sulfur asphaltenes.

2. The process of claim 1 wherein said first upstream stage effluent portion comprises between about 30 and 50 weight percent of the normally liquid material in said upstream stage effluent stream.

3. The process of claim 1 wherein said first upstream stage effluent portion comprises between about 20 and 65 weight percent of the normally liquid material in said upstream stage effluent stream.

4. The process of claim 1 wherein said first intermediate stage effluent portion comprises between about 30 and 50 weight percent of the normally liquid material in said intermediate stage effluent stream.

5. The process of claim 1 wherein said first intermediate stage effluent portion comprises between about 20 and 65 weight percent of the normally liquid material in said intermediate stage effluent stream.

6. The process of claim 1 wherein no more than 30 percent of said feed oil boiling above 650° F. is converted to material boiling below 650° F.

7. The process of claim 1 wherein not more than 10 percent of said feed oil boiling above 650° F. is converted to material boiling below 650° F.

8. The process of claim 1 wherein the catalyst in an intermediate or downstream hydrodesulfurization stage contains a promoting amount of Group IV-B metal.

* * * * *